United States Patent [19]

Livingston, III

[11] Patent Number: 5,075,671

[45] Date of Patent: Dec. 24, 1991

[54] PERSONAL ALARM SYSTEM

[76] Inventor: Robert Livingston, III, 2905 Giuffrias, Apt. 624, Metairie, La. 70001

[21] Appl. No.: 667,287

[22] Filed: Mar. 11, 1991

[51] Int. Cl.[5] ..... G08B 13/00; G08B 45/06

[52] U.S. Cl. ..... 340/574; 116/142 FP; 340/326; 340/543; 340/693

[58] Field of Search ..... 340/574, 693, 543, 326; 116/142 FP

[56] References Cited

U.S. PATENT DOCUMENTS

| | | | |
|---|---|---|---|
| 113,061 | 3/1871 | Kast | 273/84 R |
| 1,686,233 | 10/1928 | Halliday | 116/139 |
| 2,386,711 | 10/1945 | Parker | 116/67 |
| 2,554,789 | 5/1951 | Merola | 116/65 |
| 2,719,507 | 10/1955 | Aidlin et al. | 116/67 |
| 2,840,033 | 6/1958 | Nitchman | 116/112 |
| 2,893,344 | 7/1959 | Meyers | 116/112 |
| 2,908,244 | 10/1959 | Clark | 116/67 |
| 3,757,731 | 9/1973 | Pappas et al. | 116/112 |
| 4,044,712 | 8/1977 | Goodman et al. | 116/142 FP |
| 4,166,428 | 9/1979 | Freeman et al. | 116/86 |
| 4,227,482 | 10/1980 | Scheindel | 116/142 FP |
| 4,449,474 | 5/1984 | Mariol | 116/2 |
| 4,587,516 | 5/1986 | Hiraki | 340/574 X |
| 4,694,283 | 9/1987 | Leveille et al. | 340/574 |
| 4,759,309 | 7/1988 | Zediker | 116/67 |
| 5,005,002 | 4/1991 | Halperin | 340/574 |

*Primary Examiner*—Glen R. Swann, III
*Assistant Examiner*—Thomas J. Mullen, Jr.
*Attorney, Agent, or Firm*—C. Emmitt Pugh

[57] ABSTRACT

A portable, personal alarm system (A) which incorporates a loud audio alert (19, 9/10) that, when engaged, is unable to be removed from the user, or terminated without the cooperation thereof. The preferred embodiment of the present invention comprises a small, hand-held alarm system having a strap (5) with a locking mechanism for securely affixing the system to the user, compressed gas containment or electrical power for providing a loud audio horn alert, a locator light (4) for signalling the location of the user in dark areas, and a mechanism for selectively locking the horn alert in the "on" operating position which cannot be reactivated without unlocking the strap, which uses a precoded combination type lock. In use the push button (3) end (24) is placed within the palm so that the push button lies right under the fingers, with the main body (1) extending up along side of the inner side of the wrist.

11 Claims, 2 Drawing Sheets

PERSONAL ALARM SYSTEM

BACKGROUND OF INVENTION

1. Field of Invention

The present invention relates to alarm devices, and more particularly to a portable, personal alarm system which incorporates a loud audio alert that, when engaged, is unable to be removed or terminated without the cooperation of the operator.

The preferred embodiment of the present invention comprises a small, hand-held alarm having a strap with locking mechanism for securely affixing the system to the user, compressed gas containment for providing a loud audio horn alert, a locator light for signalling the location of the operator or user in dark areas, and a mechanism for selectively locking the horn alert in the "on" or "off" operating positions.

2. Prior Art & General Background

The prior art is replete with a variety of portable signalling devices utilizing compressed gas, coupled with an appropriately configured horn, as well as other small alert devices, the more pertinent of which are cited as follows:

| Patent No. | Patentee(s) | Issue Date |
|---|---|---|
| 4,759,309 | Zediker | 07/26/1988 |
| 4,449,474 | Mariol | 05/22/1984 |
| 4,227,482 | Scheindel | 10/14/1980 |
| 4,166,428 | Freeman et al | 09/04/1979 |
| 4,044,712 | Goodman et al | 08/30/1977 |
| 3,757,731 | Pappas et al | 09/11/1973 |
| 2,908,244 | Clark | 10/13/1959 |
| 2,893,344 | Meyers | 07/07/1959 |
| 2,840,033 | Nitchman | 06/24/1958 |
| 2,719,507 | S. S. Aidlin et al | 10/04/1955 |
| 2,554,789 | Merola | 05/29/1951 |
| 2,386,711 | Parker | 10/09/1945 |
| 1,686,233 | Halliday | 10/02/1928 |
| 113,061 | Kast | 03/28/1871 |

U.S. Pat. Nos. 4,759,309, 4,044,712, 2,840,033, 2,719,507, 2,554,789, and 2,386,711, all teach various, different configurations of portable audible alarm systems utilizing compressed gas means to provide an alarm which, once initiated by the user, is irreversible until the propellant is exhausted.

U.S. Pat. Nos. 4,449,474 and 2,893,344 each teach examples of portable alarm systems combining audible alert apparatus with lighted signalling means.

Lastly, U.S. Pat. No. 1,686,233 to Halliday teaches a portable sound producing device which is affixed to the user's person via an adjustable wrist strap.

As may be determined by a review of the above, the prior art does not teach or even suggest a portable, hand held personal alarm system teaching a "selectively" irreversible alarm operation. In fact, the prior art above only discloses alarm systems which are easily silenced by the user (or attacker) or which are not able to be silenced at all once initiated.

Even those alarms which claim to be "irreversible" are such that they may be destroyed by the attacker, silencing them. This is so because the alarms, being hand held, may be removed from the user and thereby may be silenced or damaged by the attacker in order to silence them.

As a result, although there has been a long-felt need for such a device, the prior art fails to teach a portable, personal alarm system which is secured to the user in such a fashion as to render it inseparable from same, thereby lessening the chances that it will be disabled or destroyed by an attacker.

GENERAL, SUMMARY DISCUSSION OF THE INVENTION

The present invention overcomes these prior art shortcomings by providing a rugged, portable alarm system which provides a highly reliable, very effective means to selectively engage the alarm in such a fashion as to render it "irreversible" by an attacker, but may be silenced by the user if desired.

The present invention, in its preferred embodiment, teaches a hand held, personal alarm system utilizing compressed air audible alarm means in conjunction with lighted signalling means, all in a small case which may be locked to the user's person. Once locked, the alarm will not be silenced if activated, unless the user unlocks the device from his or her person, thereby allowing deactivation of the alarm means.

In this manner, the present invention provides a useful, effective personal alarm system which is certain to deter further attack when activated.

It is thus an object of the present invention to provide a personal alarm system which may be reusable and renewable.

It is another object of the present invention to provide a personal alarm system which, when activated by the user, is irreversible by the attacker, but may be selectively silenced by the user only if so desired.

It is another object of the present invention to provide a personal alarm system which is affixed to the user in such a fashion as to render it inseparable from the user in the event of an attack, thereby lessening the chances of it being destroyed or disabled once initiated.

It is another object of the present invention to provide a personal alarm system which provides a means to lock the device to the user, with the locking means also being tied to the initiation mechanism of the alarm system, whereby engagement of the locking means renders the initiation of the alarm irreversible relative to an attacker, but also allows the disengagement of the locking means by the use to selectively silence the alarm.

Lastly, it an object of the present invention to provide a safe, effective, yet inexpensive and relatively mechanically unsophisticated personal alarm system, which is rugged yet lightweight, easily carried and used.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENTS

Figure 1:
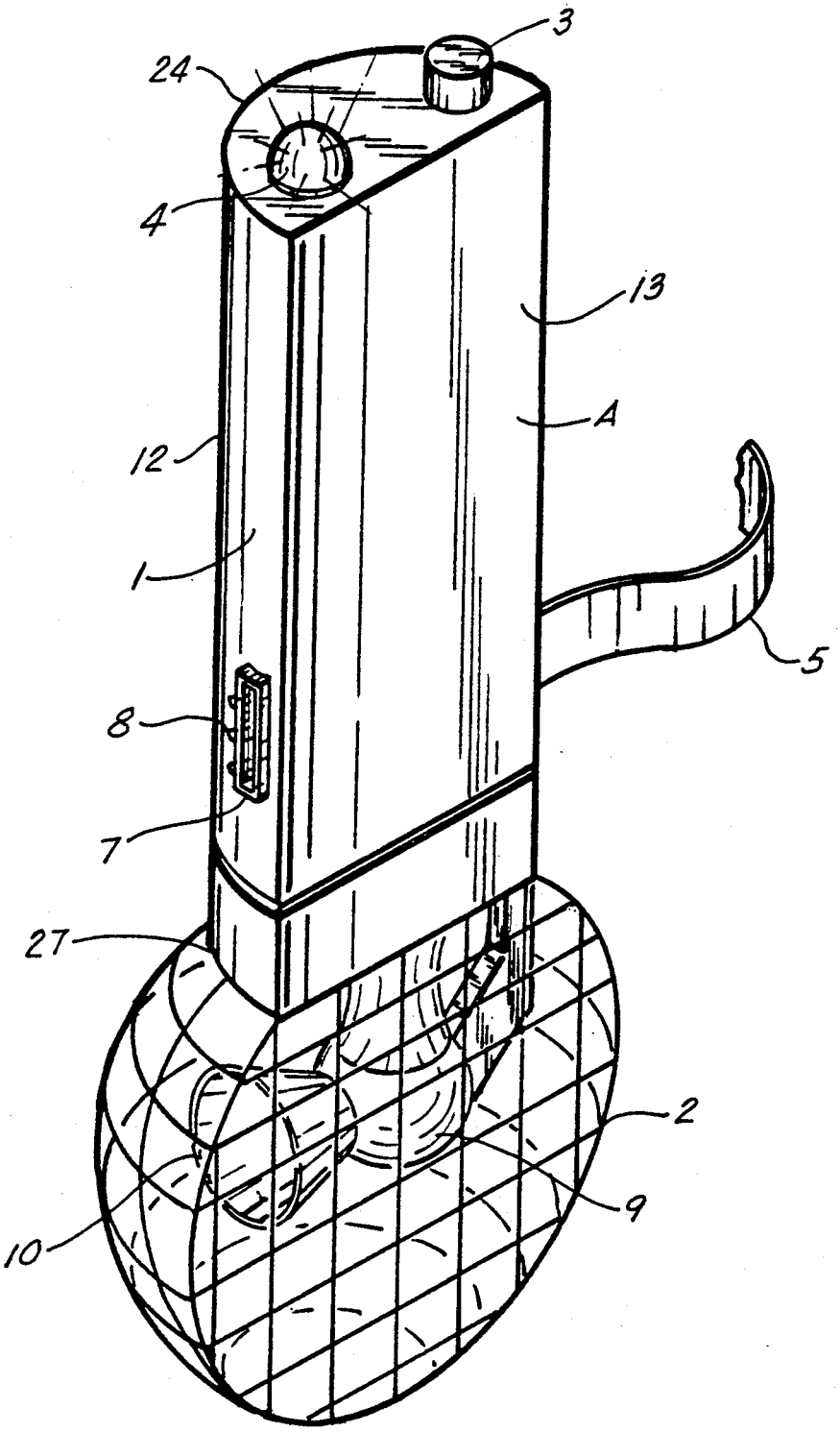
FIG. 1 is an isometric view of the preferred embodiment of the personal alarm system of the present invention.

As can be seen in FIG. 1, the personal alarm apparatus of the preferred, exemplary embodiment A of the present invention includes a case 1 having first 24 and second 27 ends, a radial or curved side 12 and a flat side 13. The case of the present exemplary embodiment may be constructed of polyethylene, polyurethane or polyvinylchloride plastic, NYLON(tm), metal, or any light, relatively strong, lightweight, and moldable or otherwise formable material.

Protruding from the first end 24 of the case is a push button 3 and a strobe or light 4. The push button forms an end of a longer member inside the case 1 and will be further described in the discussion of FIG. 3. The second end 27 of the case includes a horn/valve combination 9 and cone 10 surrounded by a protective screen or cage 2. This horn/valve combination is commonly used on relatively inexpensive "Freon" type signal horns, such as for sporting events, marine signalling, and the like.

Affixed to the first narrow side portion of the case 1 is a strap 5, while the second narrow side portion of the case has incorporated therein a retainer bracket 7 with a "tumbler" type, three or four number combination locking mechanism 8.

Strap 5 in the exemplary embodiment of the present invention may be comprised of a solid vinyl or webbed polyester or cotton, relatively flat strap of sufficient length to snugly engage the wrist of the user of the device when used in the manner intended and as described infra.

Retainer bracket 7 comprises a slotted case with the locking mechanism 8 incorporated therewith, and configured in such a fashion as to lock the strap in place, with release only upon the designation or dialing of the appropriate combination on the "tumbler" type, four number combination lock 8.

Figure 3:
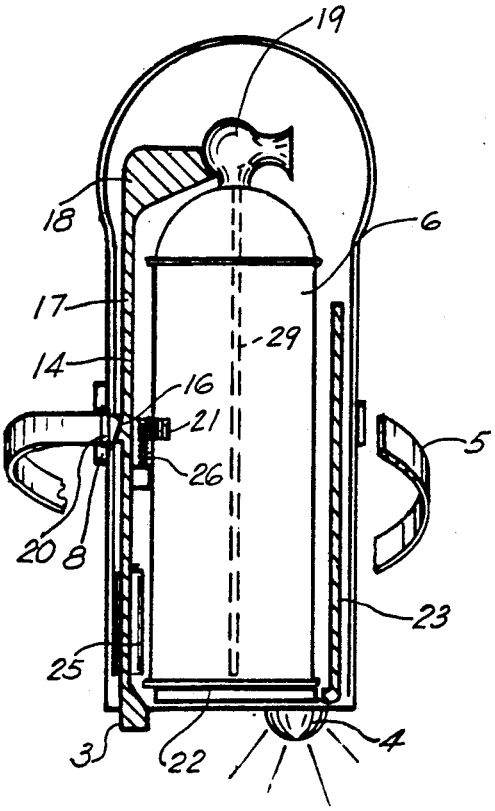
FIG. 3 is a frontal, partly cutaway view of the personal alarm system of FIG. 1, illustrating the propellant receiving tube in phantom and the mechanical configuration of the switching mechanism.

Referring to FIG. 3, the case 1 of the present invention contains a gas container 6 having a gas conduit "straw" or tube 29 therein and a propellant or compressed gas. The exemplary embodiment of the invention may utilize a twelve to sixteen (12–16) ounce aerosol propellant can or the like. Affixed to the gas container 6 is the valve/horn member 19 (9/10). For securing the can in place and facilitating its easy mounting into the case, a saddle 22 and spacer 23 arrangement is provided.

The locking engagement system for engaging the horn and light system is simple in operating configuration, dependable and inexpensive to manufacture, yet easily fabricated and assembled.

The main component in the locking system is a single, formed member 14, which comprises a blunt end having an engaging piece 18 configured for communicating with the valve/horn member 19. Member 14 also includes a tapered, extended portion 16 situated approximately mid-length of the piece, with shank extension portions 15, 17 situated juxtaposed to the ends of the piece and the mid-length area. The push button 3 forms the end of member 14 opposite to the engaging piece 18.

Further shown in the mid-section area of member 14 is a container support member 21 using a spring bias 26 for holding the container 6 in place, but configured in such a manner as to slidingly engage the container when the member is laterally moved into its "on" or "off" positions, as will be further described in the detailed discussion of the present invention's operation infra.

Further provided in communication with member 14 is a sliding electric switch 25 and battery arrangement, configured to turn "on" or "off", according to any lateral movement associated with the operation of the member. The battery/switch arrangement 25 is configured to provide power to the light 4 when the push button 3 is engaged.

Figure 4:
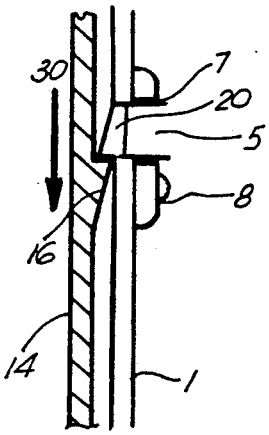
FIG. 4 is a partially cross-sectional view of the switching mechanism of the personal alarm system of FIG. 1, illustrating in close up the engagement direction and operation of the locking mechanism relative to the strap locking mechanism.
Figure 2:
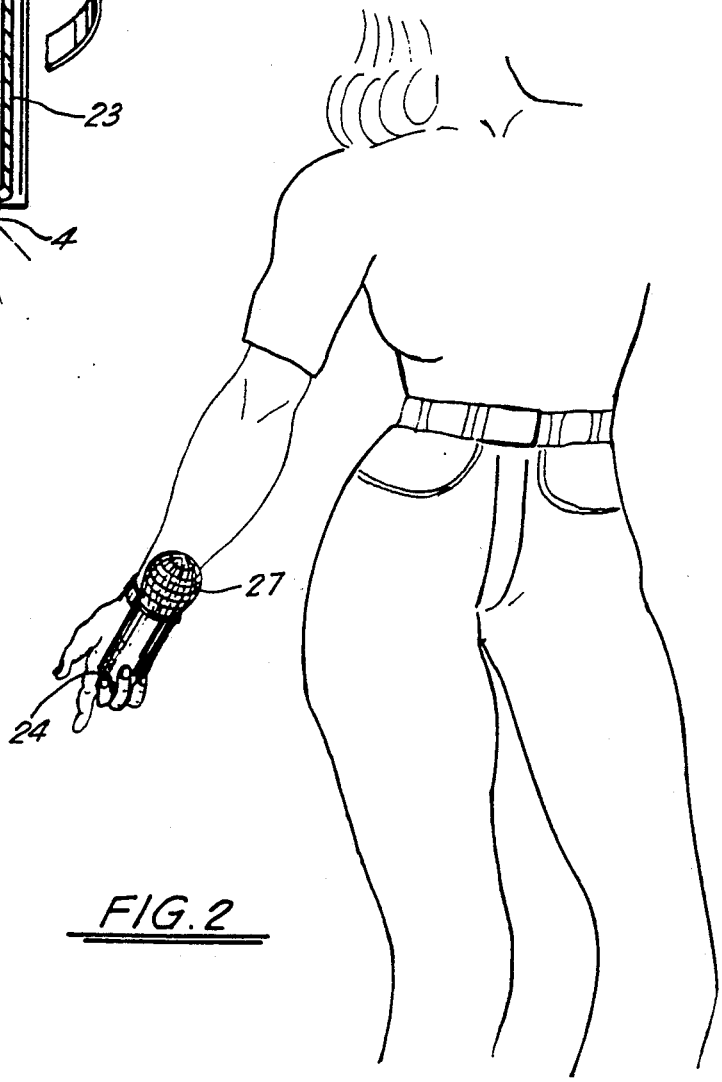
FIG. 2 is a frontal view of the personal alarm system of FIG. 1, illustrating its being locked to the user in use.

The operation of the present system is illustrated in FIGS. 2, 3, and 4. As shown in FIGS. 2 and 3, the apparatus of the present invention is secured to the wrist of the wearer via the wrist strap 5 in such a fashion as to provide the first end 24 in communication with the fingers of the user for quick and easy initiation of the alarm, and the second end 27 in communication with or lying along side the forearm of the user, to provide an area where the alarm can be initiated without damage to the user's hearing and without hampering the sound volume of the alarm. Thus, as can be clearly seen in FIG. 2, the first or bottom end 24 of the main body 1 is positioned or placed into the palm area so that the push button 3 is positioned under the finger area with the main body extending up along side of the inner side of the wrist.

As more clearly illustrated in FIG. 4, the tapered end 20 of the strap 5 is configured to lockingly engage with the lock 8 and retainer 7 mechanism. When the tapered end 20 is locked in place, it provides a means of further locking the tapered piece 16 of member 14 in the engaged position when pressure is provided by the push button 3, as illustrated in FIG. 3.

The alarm system is initiated by applying pressure to the push button 3, which in turn slides the member 14 downward. When member 14 is slid downward by the application of pressure on push button 3, pressure is translated to the valve/horn member 19, which initiates the horn, while the battery/switch arrangement 22 is switched to power the light 4, and the tapered piece 16 locks member 14 in the initiated position.

At this point, the strap 5 is locked to the user's wrist via the combination lock 8, and the system can only be silenced and/or readily removed from the user by entering the precoded combination and removing the tapered end 20 of the strap 5, allowing the member 14 to be slid from the locked "on" position to the unlocked "off" position, with the push button 3 moved into the raised, "ready" position.

The novel aspects of the present invention is not limited to alarm systems powered by a pressurized fluid. In an alternative embodiment for the power means, portable electrical power means in the form of a battery supply can be used to power such a system, occupying the space of or being substituted for the gas containment means or container 6 in the preferred embodiment supra, while an electric horn may replace the gas powered horn 12. In order to selectively power the horn in the manner taught by the above, an electrical switch may be incorporated to communicate with the locking mechanism 8, locking member 20, and intermediate area of the member 14 to provide an electrically powered version of the preferred, gas powered system.

The embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A portable alarm system that is selectively affixed to the user when utilized, comprising:

a main body having first and second sides, first and second ends, and an interior cavity with an interior wall;

power means configured to fit into said cavity of said main body and containing a power source;

power operated, audible alarm means in communication with said power means, said audible alarm means extending from said second end of said main body;

a wrist strap having first and second ends, said first end being fixedly connected to said first side of said main body, and said second end having a locking member with a tapered end;

combination type locking means configured to receive said locking member of said second end of said wrist strap to lock it in place, said locking means being situated on said second side of said main body, said locking means being configured to selectively lock said wrist strap in place effectively locking it to the wrist of the user and being unlockable only by the use of precoded combination; and a push button extending from said first end of said main body and associated with a push button member, actuation of said push button through said push button member causing said audible alarm means to be powered and actuated to continue sounding as long as said power means contains sufficient power until said combination type lock means is unlocked.

2. The portable alarm system of claim 1, wherein there is further included light indicia means affixed to said first end of said main body, said light indicia means providing a visual signal, said light indicia means being configured to be initiated upon initiation of said audible alarm means.

3. The portable alarm system of claim 2, wherein said light indicia means comprises a strobe.

4. The portable alarm system of claim 2, wherein said light indicia means further comprises a switch/battery combination, said switch/battery combination being configured to initiate power to said light indicia means when said push button is pressed in a downward position.

5. The portable alarm system of claim 1, wherein said push button member further comprises a sliding engagement device communicating with said power means and providing side wall support to said power means and spacing said power means in said cavity of said main body.

6. The portable alarm system of claim 1, wherein said power means comprises a compressed gas or aerosol fluid under pressure.

7. The portable alarm system Of claim 1, wherein said power means comprises a portable electrical power means for storing electrical power.

8. A method of alerting others of a personal emergency utilizing a personal alarm system that is selectively affixed to the user when utilized, comprising the following steps:

a. using a portable alarm apparatus, comprising a main body having first and second sides, first and second ends, and an interior cavity with an interior wall;

power means configured to fit into said cavity of said main body and containing a power source;

power operated, audible alarm means in communication with said power means, said audible alarm means extending from said second end of said main body;

a strap having first and second ends, said first end being connected to said first side of said main body and said second end having a locking member with a tapered end;

locking means configured to receive said locking member of said second end of said strap, said locking means being configured to selectively lock said strap in place using a combination type lock; and a push button member having first and second ends and an intermediate area, said first end of said member configured to form a push button extending out from said first end of said main body, said second end being configured to communicate with said audible alarm means, said member being in communication with said power means, actuation of said push button causing said audible alarm means to be powered, causing an audible alarm to sound;

b. wrapping said strap about a part of the user's body and locking said locking member of said strap in said locking means so that said strap snugly fits about the body part and cannot be readily removed without unlocking said locking means;

c. carrying said portable alarm apparatus so that said push button is able to be quickly pressed when so desired;

d. pressing said push button when an emergency situation occurs, initiating said audible alarm means in a "locked on" fashion; and e. thereafter unlocking said locking means, terminating said audible alarm means, after the threatening situation has ceased.

9. The method of claim 8, wherein said locking means comprises a precoded combination type lock and wherein in step "e" there is included the step of:

entering the precoded combination into the combination lock to unlock it.

10. The method of claim 8, wherein said strap is a wrist strap, and said body part is the user's wrist and wherein in step "b" there is included the steps of:

holding said portable alarm apparatus in the hand; and placing said first end of said main body into the palm area so that said push button is positioned under the finger area with said main body extending up along side the inner side of the wrist; and wrapping said strap about the wrist and locking said alarm apparatus to the wrist.

11. The method of claim 8, wherein in step "a" there is included the further step of using light indicia means affixed to said first end of said main body to provide a visual signal, with said light indicia means being configured to be initiated upon initiation of said audible alarm means.

* * * * *